US007203981B1

(12) United States Patent
Cowgill

(10) Patent No.: US 7,203,981 B1
(45) Date of Patent: Apr. 17, 2007

(54) PORTABLE ROCKER FOR BABY CRIBS AND THE LIKE

(76) Inventor: Joy Cowgill, 2296 Crypris Landing Dr., Atlantic Beach, FL (US) 32233

( * ) Notice: Subject to any disclaimer, the term of this patent is extended or adjusted under 35 U.S.C. 154(b) by 0 days.

(21) Appl. No.: 11/526,537

(22) Filed: Sep. 25, 2006

Related U.S. Application Data

(60) Provisional application No. 60/721,948, filed on Sep. 30, 2005.

(51) Int. Cl.
*A47D 9/02* (2006.01)

(52) U.S. Cl. ..... 5/109; 5/108; 5/93.1; 5/904

(58) Field of Classification Search ..... 5/109, 5/108, 101, 93.1, 904, 915, 607–610
See application file for complete search history.

(56) References Cited

U.S. PATENT DOCUMENTS 2,350,563 A * 6/1944 Logan ..... 601/59
2,531,858 A * 11/1950 Miller ..... 5/109
3,075,205 A * 1/1963 Canova ..... 5/109
3,668,721 A * 6/1972 Jenkins ..... 5/109
3,802,003 A * 4/1974 Laureti ..... 5/108
4,656,680 A 4/1987 Wilson
4,793,010 A * 12/1988 Gross et al. ..... 5/109
4,881,285 A * 11/1989 Zeeb ..... 5/103
5,048,135 A 9/1991 Chen
5,307,531 A 5/1994 Kao
5,806,113 A * 9/1998 McMahan et al. ..... 5/109

* cited by examiner

*Primary Examiner*—Robert G. Santos

(57) ABSTRACT

A rocker includes a basket pivotally mounted to the crib that has a mattress laying horizontally therein and covering an entire bottom thereof. First and second brackets couple to an outer surface of the basket and are located at axially opposed ends thereof. First and second pairs of anchor arms have proximal ends connected to the brackets. The anchor arms have axially opposed distal ends spanning away from the basket and terminating adjacent to a frame of the crib. The arms are telescopically adjustable along a longitudinal length thereof and each of the arms are independently articulated. A plurality of support levers are conjoined to a top edge of the crib and are connected to the distal ends of the arms. The device includes a mechanism for oscillating the basket and a mechanism for automatically playing back an audio file while the basket is oscillating.

18 Claims, 6 Drawing Sheets

PORTABLE ROCKER FOR BABY CRIBS AND THE LIKE

CROSS REFERENCE TO RELATED APPLICATIONS

This application claims the benefit of U.S. Provisional Application No. 60/721,948, filed Sep. 30, 2005.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to rocking devices and, more particularly, to a portable rocker attachable to an existing baby crib and the like for soothing a restless infant.

2. Prior Art

Many new parents enjoy spending time with their child by instinctively rocking the child in a gentle, back and forth motion. Whether by sitting in an oversized antique rocking chair or simply by rocking their own body back and forth, most parents find that this repetitive rocking motion can soothe and calm the child, particularly if the child is irritable or experiencing discomfort caused by colic or similar minor maladies. Serving to comfort and hush the crying infant, a gentle rocking motion can also lull the child softly to sleep. While hours spent rocking a child can be a special period of bonding for both the parent and the child, there are those occasions where it is not always possible for the parent to hold their child in this manner.

One prior art example shows a rocking cradle which allows for a hanging cradle contained within a supporting frame to be aided in its cyclical transverse displacement by magnetic attraction and repelling forces. Central magnets are mounted on the hanging cradle and are attracted and repelled by a pair of magnets mounted on the supporting frame with one of the magnets being fixed to the supporting frame and the other magnet being rotatively displaceable with respect to the first magnet. Transverse displacement of the hanging cradle causes pivoting of one of the magnets on the supporting frame which then allows a repelling force from the stationary magnet to act against the magnets mounted on the hanging cradle to displace the hanging cradle away from the magnets on the supporting frame.

Another prior art example shows a swinging assembly for cribs comprises a crib with two opposite inner frames at its two opposite sides, two outer frames matching the two inner frames, two lateral braces supporting the inner frames, an electrical apparatus, and a magnetic device. A switching apparatus is disposed between the lateral brace and the outer frame. The electrical apparatus is installed in a lower interior of the lateral brace. The electrical apparatus has a silicon controlled rectifier, two diodes and a transformer. A non-magnetic partition separates the electrical apparatus and the magnetic device. The magnetic device has two permanent magnets which are positioned by a securing seat. The securing seat is positioned by a corrugated plate which is disposed under the crib. Unfortunately, both of these examples are self-contained units that are not suitable for use with existing cribs. Additionally, these examples are not removable and transportable.

Accordingly, a need remains for a portable rocker for baby cribs and the like in order to overcome the above-mentioned shortcomings. The present invention satisfies such a need by providing a device that is simple and easy to use, is lightweight yet durable in design, and provides parents and caregivers with a simple and convenient means of soothing an irritated or restless infant through a tranquil rocking motion. Such a device conveniently offers hands-free rocking of a child for a set period of minutes, thereby advantageously allowing a caregiver to tend to other matters while the child is soothed. The device also provides soothing sounds and vibration to effectively aid in relaxing the child.

BRIEF SUMMARY OF THE INVENTION

In view of the foregoing background, it is therefore an object of the present invention to provide a device for a portable rocker for baby cribs and the like. These and other objects, features, and advantages of the invention are provided by a portable rocker attachable to an existing baby crib and the like for soothing a restless infant.

The device includes an oscillating basket pivotally mounted to the crib. Such a basket has a conveniently removable mattress laying horizontally therein and effectively covering an entire bottom surface of the basket. Such a removable mattress is formed from a soft water-resistant material such that an infant can comfortably rest thereon. The mattress is conveniently machine-washable such that the mattress can be effectively cleaned and used repeatedly. The device further includes first and second brackets directly coupled to an outer surface of the basket and advantageously located at axially opposed ends thereof.

The device further includes first and second pairs of rectilinear anchor arms that have proximal ends pivotally connected to the first and second brackets respectively. Such first and second pairs of anchor arms conveniently have axially opposed distal ends laterally spanning away from the basket and advantageously terminating adjacent to a frame of the crib. The first and second pairs of anchor arms are telescopically adjustable along a longitudinal length thereof such that the basket can be effectively attached to alternate portions of the crib while the basket conveniently remains medially and centrally oriented within the crib. Each of the first and second pairs of anchor arms are independently articulated such that the basket is longitudinally adjusted within the crib. The first and second pairs of anchor arms are advantageously pivotal along a path coplanar with an oscillating path of the basket.

The device further includes a plurality of support levers removably conjoined directly to a top edge of the crib. Such support levers are linearly displaced along the top edge such that the first and second pairs of anchor arms become advantageously articulated about the proximal ends thereof respectively. Distal ends of the first and second pairs of anchor arms are pivotally connected to the support levers such that the proximal and distal ends of the anchor arms are simultaneously pivotal about vertically registered fulcrum axes. The support levers effectively maintain the basket in a substantially horizontal position and spaced from a bottom surface of the crib such that the basket freely oscillates during operating conditions The device further includes a mechanism for symmetrically oscillating the basket along a horizontal plane while the first and second pairs of anchor arms remain statically engaged with the top edge of the crib. Such a basket oscillating mechanism preferably includes an axle and a chamfered drum journaled thereabout. Such a chamfered drum conveniently has an oscillating groove defined along an outer circumference thereof and continuously extending along an outer surface of the drum. A motor is electrically coupled to the drum and advantageously housed on an exterior of the basket.

The basket oscillating mechanism further includes a linear drive shaft conveniently provided with a rotary ball bearing attached to a first end thereof. Such a ball bearing is freely interfitted within the groove such that the ball bearing effectively travels an entire length of the groove while the drum rotates. A threaded coupling is directly mated to a second end of the driveshaft. A rectilinear driven shaft conveniently has first and second ends directly mated to the coupling and one of the ends of the basket respectively. A threaded rod is directly passed through the coupling, such that the basket is uniformly displaced along a longitudinal length of the rod while the ball bearing travels along the groove such that the basket effectively oscillates in sync with a travel path of the ball bearing.

The basket oscillating mechanism further includes a user interface electrically mated to the motor such that a user can manually adjust an operating mode of the basket oscillating mechanism. Such a user interface includes a plurality of switches integrally formed within a top surface thereof such that a user can selectively control a vibration intensity and duration of oscillation of the basket. The user interface further includes a variable pitch generating circuit for allowing a user to select various sounds to emit from the mattress. The user interface is electrically mated to the power supply and housed in an exterior surface thereof.

The device further includes a mechanism for automatically playing back an audio file while the basket is oscillating. Such an audio file playback mechanism includes a rechargeable power supply source, an audio file playback device and a sensor electrically coupled to the power supply source and the basket oscillating mechanism respectively. Such a sensor effectively generates and transmits a first control signal to the audio file playback device when the oscillating movement is detected in the basket such that the audio file playback device automatically toggles between on and off positions when the basket oscillates and remains at equilibrium respectively. The audio file playback mechanism further includes a transducer operably connected directly to the mattress and electrically mated to the sensor and the audio file playback device respectively. The sensor further effectively generates and transmits a second control signal to the transducer when either one of the basket oscillating mechanism and the audio file playback device are adapted to an operating mode.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
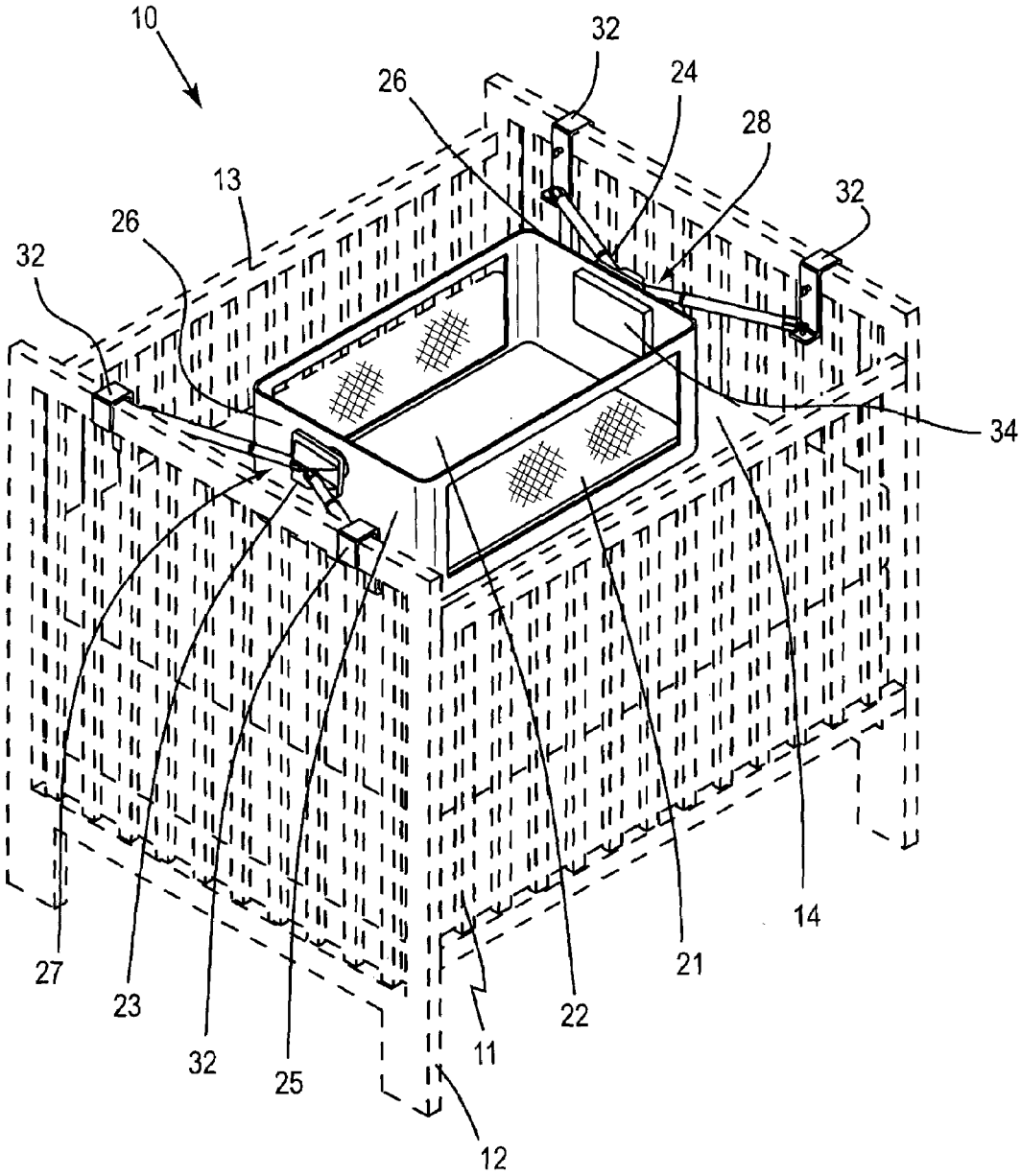
FIG. 1 is a perspective view showing a portable rocker for baby cribs and the like attached to a crib, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The device of this invention is referred to generally in FIGS. 1–7 by the reference numeral 10 and is intended to provide a portable rocker for baby cribs and the like. It should be understood that the device 10 may be used with many different types of cribs and should not be limited in use to only those cribs described herein.

Referring initially to FIGS. 1, 2, 3 and 4, the device 10 includes an oscillating basket 21 pivotally mounted to the crib 11. Such a basket 21 has a conveniently removable mattress 22 lying horizontally therein and effectively covering an entire bottom surface of the basket 21. Such a mattress 22 is formed from a soft water-resistant material, which is essential such that an infant can comfortably rest thereon. The mattress 22 is conveniently machine-washable, which is vital such that the mattress 22 can be effectively cleaned and used repeatedly. Of course, such a mattress 22 can be made from a variety of suitably soft, water-resistant and machine-washable materials, as is obvious to a person of ordinary skill in the art. The device 10 further includes first 23 and second 24 brackets directly coupled to an outer surface 25 of the basket 21, without the use of intervening elements, and advantageously located at axially opposed ends 26 thereof.

Referring to FIGS. 1, 2, 3, 4 and 5, the device 10 further includes first 27 and second 28 pairs of rectilinear anchor arms that have proximal ends 29 pivotally connected to the first and second brackets 23, 24 respectively. Such first and second pairs of anchor arms 27, 28 conveniently have axially opposed distal ends 31 laterally spanning away from the basket 21 and advantageously terminating adjacent to a frame 12 of the crib 11. The first and second pairs of anchor arms 27, 28 are telescopically adjustable along a longitudinal length thereof, which is critical such that the basket 21 can be effectively attached to alternate portions of the crib 11 while the basket 21 conveniently remains medially and centrally oriented within the crib 11. Each of the first and second pairs of anchor arms 27, 28 are independently articulated such that the basket 21 is longitudinally adjusted within the crib 11. The first and second pairs of anchor arms 27, 28 are advantageously pivotal along a path coplanar with an oscillating path of the basket 21.

Figure 2:
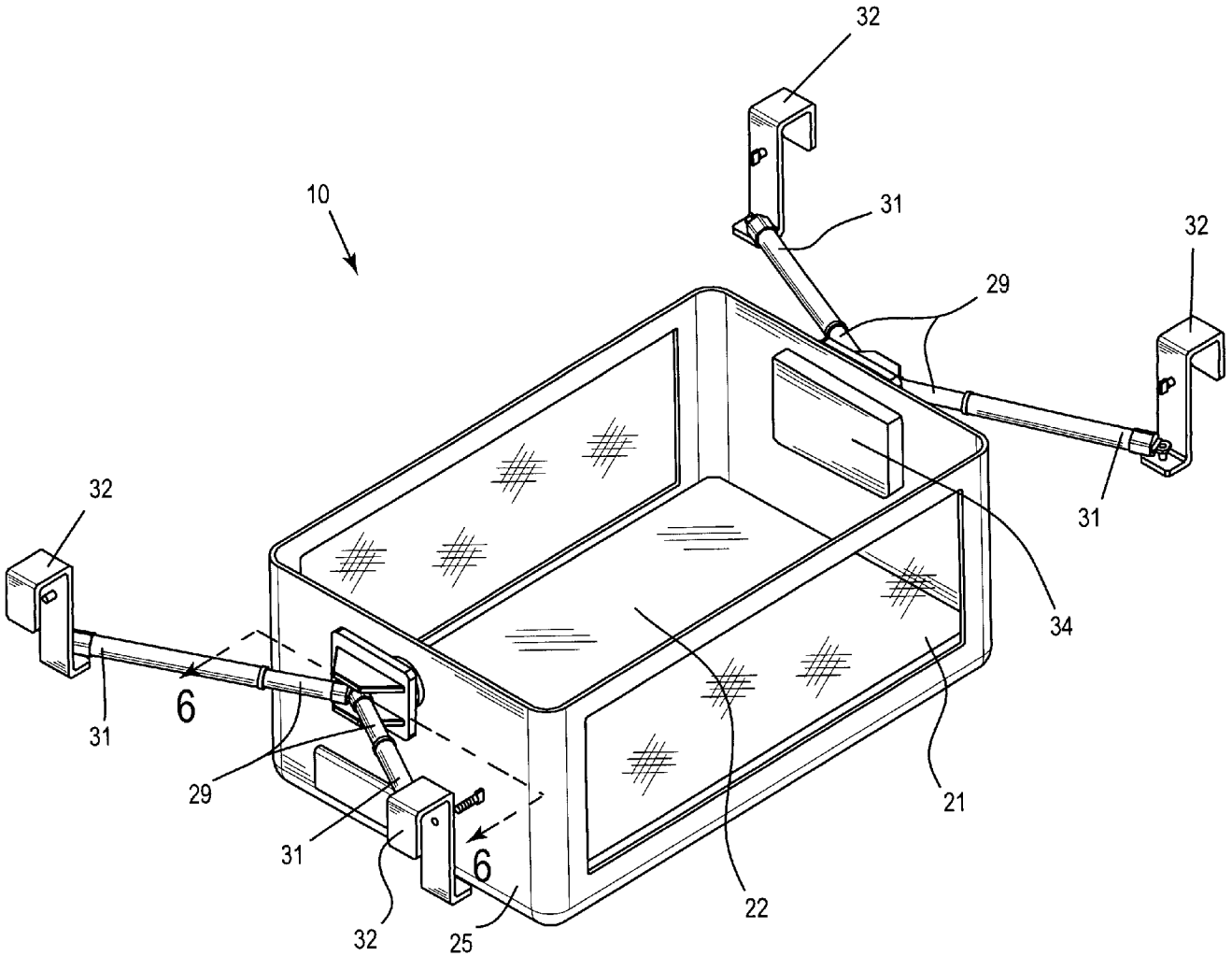
FIG. 2 is a perspective view of the device shown in FIG. 1 detached from the crib.
Figure 3:
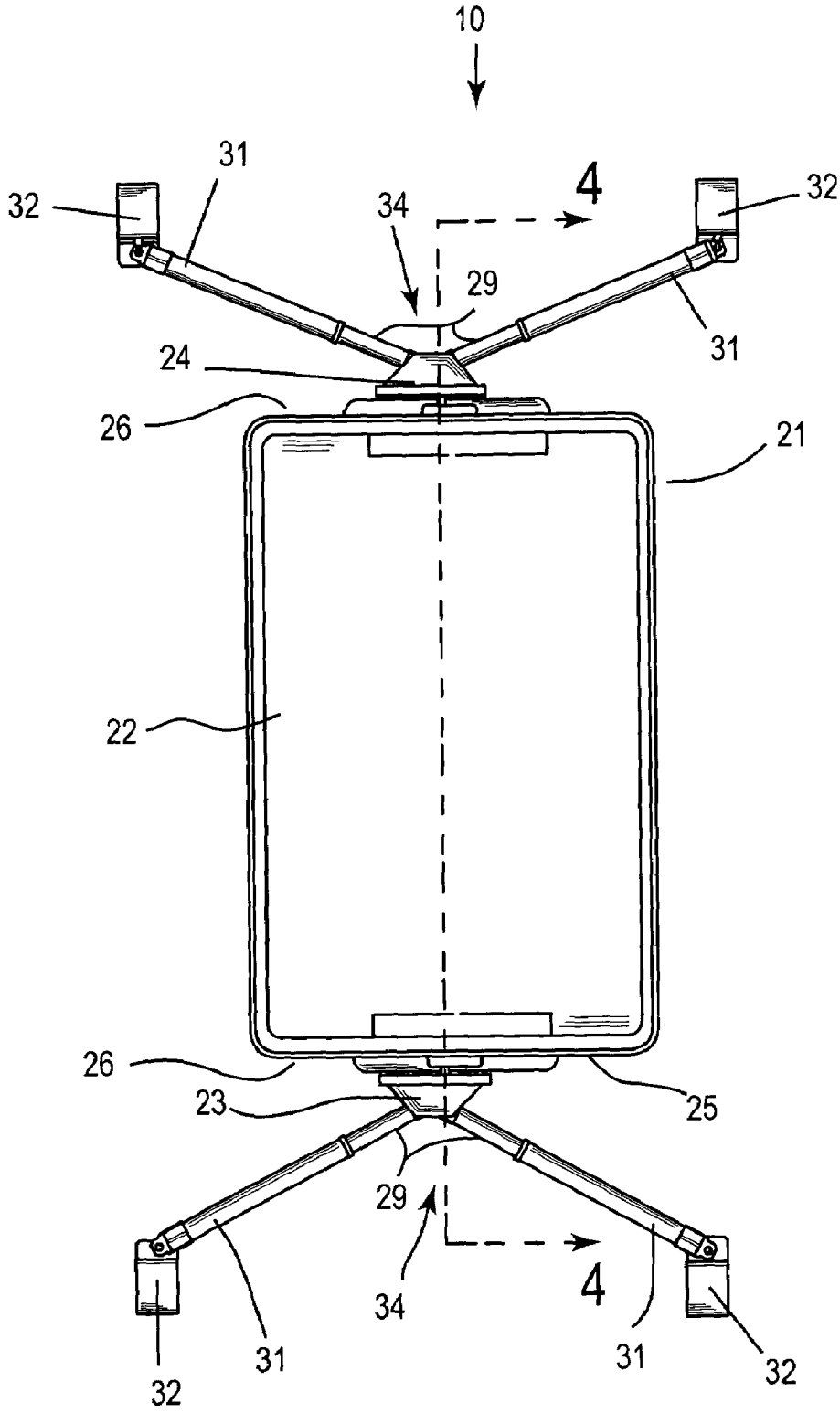
FIG. 3 is a top plan view of the device shown in FIG. 2.

Referring to FIGS. 1, 2 and 3, the device 10 further includes a plurality of support levers 32 removably conjoined directly to a top edge 13 of the crib 11, without the use of intervening elements. Such support levers 32 are linearly displaced along the top edge 13, which is crucial such that the first and second pairs of anchor arms 27, 28 become advantageously articulated about the proximal ends 29 thereof respectively. Distal ends 31 of the first and second pairs of anchor arms 27, 28 are pivotally connected to the support levers 32, which is important such that the proximal and distal ends 29, 31 of the anchor arms 27, 28 are simultaneously pivotal about vertically registered fulcrum axes. The support levers 32 effectively maintain the basket 21 in a substantially horizontal position and spaced from a bottom surface 14 of the crib 11, which is essential such that the basket 21 freely oscillates during operating conditions. The associated anchor arms 27, 28 and support levers 32 provide the unexpected benefit of portability of the device 10, thereby overcoming prior art shortcomings.

Referring to FIGS. 1, 2, 3, 4, 5, 6 and 7, the device 10 further includes a mechanism 34 for symmetrically oscillating the basket 21 along a horizontal plane while the first and second pairs of anchor arms 27, 28 remain statically engaged with the top edge 13 of the crib 11. Such a basket oscillating mechanism 34 includes an axle 35 and a chamfered drum 36 journaled thereabout. Such a chamfered drum 35 conveniently has an oscillating groove 37 defined along an outer circumference thereof and continuously extending along an outer surface 38 of the drum 35. A motor 39 is electrically coupled to the drum 36 and advantageously housed on an outer surface 25 of the basket 21. Of course, such a drum 35 can be produced in a variety of sizes, as is obvious to a person of ordinary skill in the art.

Figure 4:
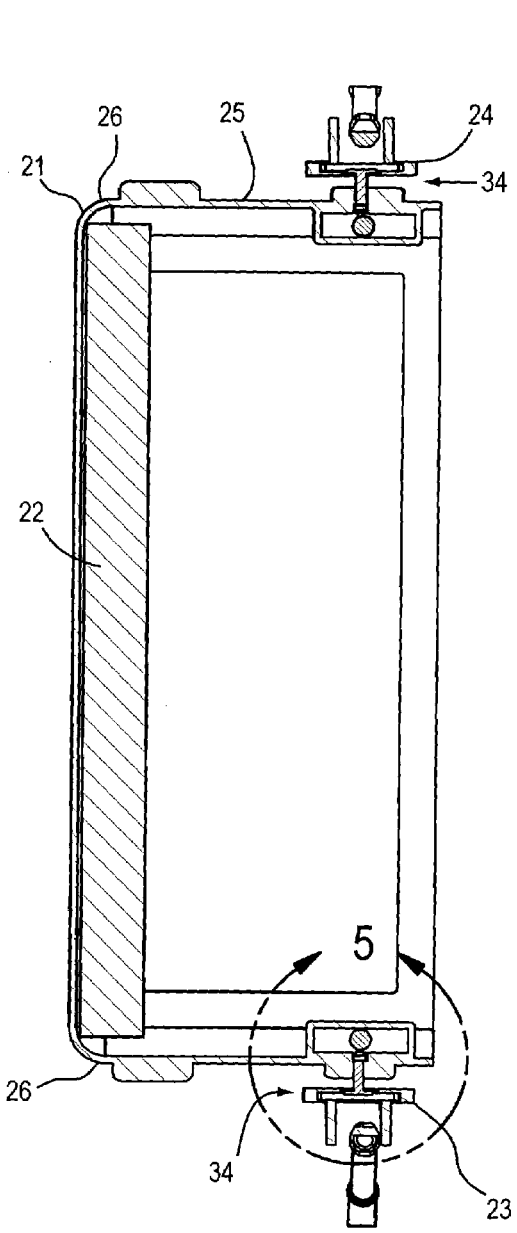
FIG. 4 is a cross sectional view of the device shown in FIG. 3, taken along line 4—4.
Figure 5:
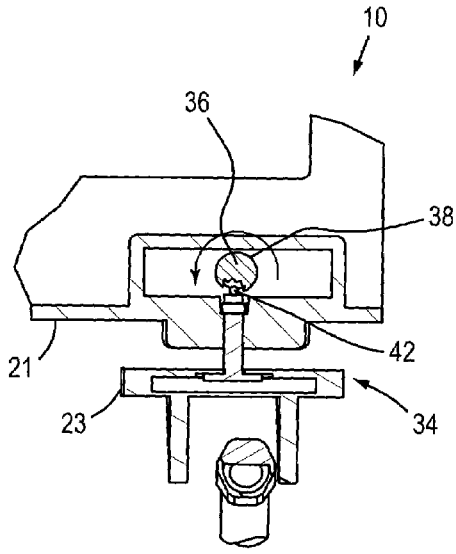
FIG. 5 is an expanded cross sectional view of the basket oscillating mechanism shown in FIG. 5.
Figure 6:
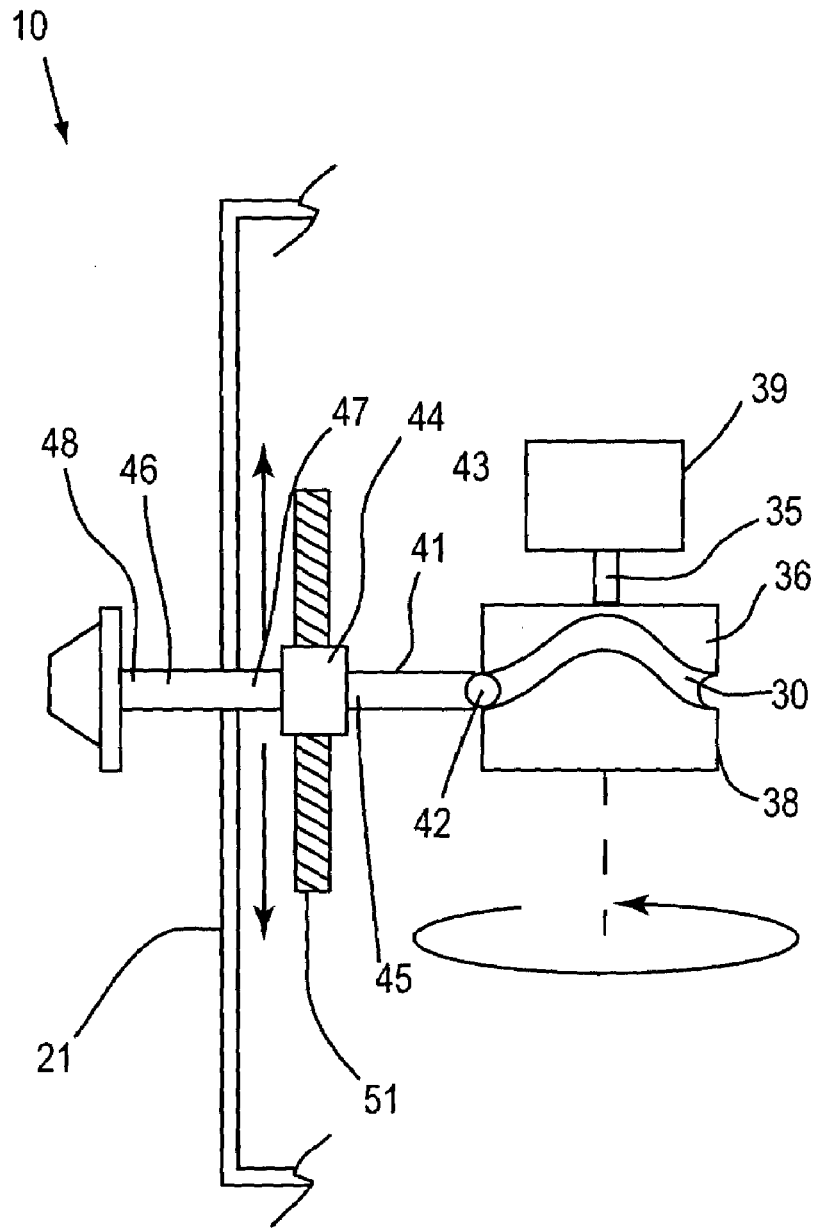
FIG. 6 is a schematic diagram of the basket oscillating mechanism shown in FIG. 4.

Referring to FIGS. 4, 5 and 6, the basket oscillating mechanism 34 further includes a linear drive shaft 41 conveniently provided with a rotary ball bearing 42 attached to a first end 43 thereof. Such a ball bearing 42 is freely interfitted within the groove 37, which is critical such that the ball bearing 42 effectively travels an entire length of the groove 37 while the drum 35 rotates. A threaded coupling 44 is directly mated to a second end 45 of the drive shaft 41, without the use of intervening elements.

A rectilinear driven shaft 46 conveniently has first 47 and second 48 ends directly mated to the coupling 44, without the use of intervening elements, and one of the ends 26 of the basket 21 respectively. A threaded rod 51 is directly passed through the coupling 44, without the use of intervening elements, which is crucial such that the basket 21 is uniformly displaced along a longitudinal length of the rod 51 while the ball bearing 42 travels along the groove 37, which is important such that the basket 21 effectively oscillates in sync with a travel path of the ball bearing 42.

Figure 7:
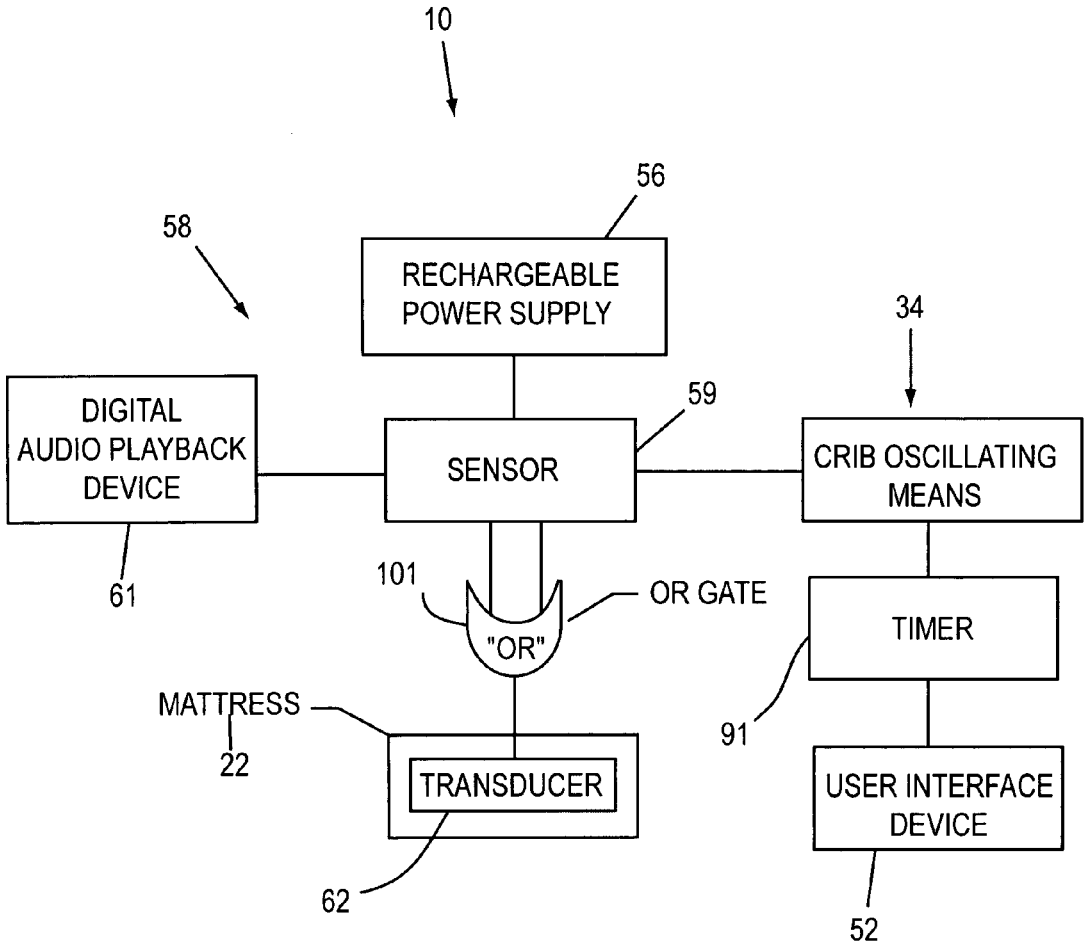
FIG. 7 is a schematic block diagram showing the interrelationship of the main electrical components of the present invention.

Referring to FIG. 7, the basket oscillating mechanism 34 further includes a user interface 52 electrically mated to the motor 39, which is essential such that a user can manually adjust an operating mode of the basket oscillating mechanism 34. Such a user interface 52 includes a plurality of switches 53 integrally formed within a top surface 54 thereof, and a timer 91, which is vital such that a user can selectively control a vibration intensity and duration of oscillation of the basket 21. The user interface 52 further includes a variable pitch generating circuit 55, which is critical for allowing a user to select various sounds to emit from the mattress 22. The user interface 52 is electrically mated to the power supply 56 (herein described below) and housed in an exterior surface thereof.

Again referring to FIG. 7, the device 10 further includes a mechanism 58 for automatically playing back an audio file while the basket 21 is oscillating. Such an audio file playback mechanism 58 includes a rechargeable power supply source 56, an audio file playback device 61, and a sensor 59 electrically coupled to the power supply source 56 and the basket oscillating mechanism 34 respectively.

An "OR" gate 101 is electrically coupled to the sensor 59 and the transducer 62 in such a manner that the transducer 62 is toggled to an operating mode when either the crib oscillating mechanism 34 or the digital audio playback device 61 is operating. In particular, the sensor 59 transmits two separate input signals to gate 101. If either one of such input signals have a voltage value corresponding to a "true" value, then gate 101 will generate and transmit an output signal to the transducer 62, which instructs said transducer 62 to switch to the operating mode. If both of the input signals correspond to a "false" value, then the output signal instructs the transducer 62 to toggle back to a non-operating mode.

Such a sensor 59 effectively generates and transmits a first control signal to the audio file playback device 61 when the oscillating movement is detected in the basket 21, which is crucial such that the audio file playback device 61 automatically toggles between on and off positions when the basket 21 oscillates and remains at equilibrium respectively. The audio file playback mechanism 58 further includes a transducer 62 operably connected directly to the mattress 22, without the use of intervening elements, and electrically mated to the sensor 59 and the audio file playback device 61 respectively. The sensor 59 further effectively generates and transmits a second control signal to the transducer 62 when either one of the basket oscillating mechanism 34 and the audio file playback device 61 are adapted to an operating mode.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A portable rocker attachable to an existing baby crib for soothing a restless infant, said rocker comprising:

an oscillating basket pivotally mounted to the crib, said basket having a removable mattress laying horizontally therein and covering an entire bottom surface of said basket;

first and second brackets directly coupled to an outer surface of said basket, said brackets being located at axially opposed ends of said basket;

first and second pairs of rectilinear anchor arms having proximal ends pivotally connected to said first and second brackets respectively, said first and second pairs of anchor arms further having axially opposed distal ends laterally spanning away from said basket and terminating adjacent to a frame of the crib, said first and second pairs of anchor arms being telescopically adjustable along a longitudinal length thereof such that said basket can be attached to alternate portions of the crib while said basket remains medially and centrally oriented within the crib;

a plurality of support levers removably conjoined directly to a top edge of the crib wherein said support levers are linearly displaced along said top edge such that said first and second pairs of anchor arms become articulated about said proximal ends thereof respectively, said distal ends of said first and second pairs of anchor arms being pivotally connected to support levers such that said proximal and distal ends of said anchor arms are simultaneously pivotal about vertically registered fulcrum axes, wherein said support levers maintain said basket in a substantially horizontal position and spaced from a bottom surface of the crib such that said basket freely oscillates during operating conditions;

means for symmetrically oscillating said basket along a horizontal plane while said first and second pairs of anchor arms remain statically engaged with said top edge of the crib; and means for automatically playing back an audio file while said basket is oscillating.

2. The rocker of claim 1, wherein said basket oscillating means comprises:

an axle and a chamfered drum journaled thereabout, said chamfered drum having an oscillating groove defined along an outer circumference thereof and continuously extending along an outer surface of said drum;

a motor electrically coupled to said drum and housed on an exterior of said basket;

a linear drive shaft provided with a rotary ball bearing attached to a first end thereof, said ball bearing being freely interfitted within said groove such that said ball bearing travels an entire length of said groove while said drum rotates;

a threaded coupling directly mated to a second end of said driveshaft;

a rectilinear driven shaft having first and second ends directly mated to said coupling and one of said ends of said basket respectively;

a threaded rod directly passed through said coupling, wherein said basket is uniformly displaced along a longitudinal length of said rod while said ball bearing travels along said groove such that said basket oscillates in sync with a travel path of said ball bearing; and a user interface electrically mated to said motor such that a caregiver can manually adjust an operating mode of said basket oscillating means.

3. The rocker of claim 1, wherein said audio file playback means comprises:

a rechargeable power supply source;

a sensor electrically coupled to said power supply source and said basket oscillating means;

a digital audio file playback device; and a transducer operably connected directly to said mattress and electrically mated to said sensor and said audio file playback device respectively.

4. The sensor of claim 3, wherein said sensor generates and transmits a first control signal to said audio file playback device when said oscillating movement is detected in said basket such that said audio file playback device automatically toggles between on and off positions when said basket oscillates and remains at equilibrium respectively, said sensor further generating and transmitting a second control signal to said transducer when either one of said basket oscillating means and said audio file playback device are adapted to an operating mode.

5. The basket oscillating means of claim 2, wherein said user interface includes a plurality of switches integrally formed within a top surface thereof such that a user can selectively control an vibration intensity and duration of oscillation of said basket, said user interface further includes a variable pitch generating circuit for allowing a user to select various sounds to emit from said mattress, said control panel being electrically mated to a power supply and housed in an exterior surface thereof.

6. The rocker of claim 1, wherein said removable mattress is formed from a soft water-resistant material such that an infant can comfortably rest thereon, said mattress being machine washable such that said mattress can be cleaned and used repeatedly.

7. A portable rocker attachable to an existing baby crib for soothing a restless infant, said rocker comprising:

an oscillating basket pivotally mounted to the crib, said basket having a removable mattress laying horizontally therein and covering an entire bottom surface of said basket;

first and second brackets directly coupled to an outer surface of said basket, said brackets being located at axially opposed ends of said basket;

first and second pairs of rectilinear anchor arms having proximal ends pivotally connected to said first and second brackets respectively, said first and second pairs of anchor arms further having axially opposed distal ends laterally spanning away from said basket and terminating adjacent to a frame of the crib, said first and second pairs of anchor arms being telescopically adjustable along a longitudinal length thereof such that said basket can be attached to alternate portions of the crib while said basket remains medially and centrally oriented within the crib, wherein each of said first and second pairs of anchor arms are independently articulated such that said basket is longitudinally adjusted within said crib;

a plurality of support levers removably conjoined directly to a top edge of the crib wherein said support levers are linearly displaced along said top edge such that said first and second pairs of anchor arms become articulated about said proximal ends thereof respectively, said distal ends of said first and second pairs of anchor arms being pivotally connected to support levers such that said proximal and distal ends of said anchor arms are simultaneously pivotal about vertically registered fulcrum axes, wherein said support levers maintain said basket in a substantially horizontal position and spaced from a bottom surface of the crib such that said basket freely oscillates during operating conditions;

means for symmetrically oscillating said basket along a horizontal plane while said first and second pairs of anchor arms remain statically engaged with said top edge of the crib; and means for automatically playing back an audio file while said basket is oscillating.

8. The rocker of claim 7, wherein said basket oscillating means comprises:

an axle and a chamfered drum journaled thereabout, said chamfered drum having an oscillating groove defined along an outer circumference thereof and continuously extending along an outer surface of said drum;

a motor electrically coupled to said drum and housed on an exterior of said basket;

a linear drive shaft provided with a rotary ball bearing attached to a first end thereof, said ball bearing being freely interfitted within said groove such that said ball bearing travels an entire length of said groove while said drum rotates;

a threaded coupling directly mated to a second end of said driveshaft;

a rectilinear driven shaft having first and second ends directly mated to said coupling and one of said ends of said basket respectively;

a threaded rod directly passed through said coupling, wherein said basket is uniformly displaced along a longitudinal length of said rod while said ball bearing travels along said groove such that said basket oscillates in sync with a travel path of said ball bearing; and a user interface electrically mated to said motor such that a caregiver can manually adjust an operating mode of said basket oscillating means.

9. The rocker of claim 7, wherein said audio file playback means comprises:

a rechargeable power supply source;

a sensor electrically coupled to said power supply source and said basket oscillating means;

a digital audio file playback device; and a transducer operably connected directly to said mattress and electrically mated to said sensor and said audio file playback device respectively.

10. The sensor of claim 9, wherein said sensor generates and transmits a first control signal to said audio file playback device when said oscillating movement is detected in said basket such that said audio file playback device automatically toggles between on and off positions when said basket oscillates and remains at equilibrium respectively, said sensor further generating and transmitting a second control signal to said transducer when either one of said basket oscillating means and said audio file playback device are adapted to an operating mode.

11. The basket oscillating means of claim 8, wherein said user interface includes a plurality of switches integrally formed within a top surface thereof such that a user can selectively control an vibration intensity and duration of oscillation of said basket, said user interface further includes a variable pitch generating circuit for allowing a user to select various sounds to emit from said mattress, said control panel being electrically mated to a power supply and housed in an exterior surface thereof.

12. The rocker of claim 7, wherein said removable mattress is formed from a soft water-resistant material such that an infant can comfortably rest thereon, said mattress being machine washable such that said mattress can be cleaned and used repeatedly.

13. A portable rocker attachable to an existing baby crib for soothing a restless infant, said rocker comprising:

an oscillating basket pivotally mounted to the crib, said basket having a removable mattress laying horizontally therein and covering an entire bottom surface of said basket;

first and second brackets directly coupled to an outer surface of said basket, said brackets being located at axially opposed ends of said basket;

first and second pairs of rectilinear anchor arms having proximal ends pivotally connected to said first and second brackets respectively, said first and second pairs of anchor arms further having axially opposed distal ends laterally spanning away from said basket and terminating adjacent to a frame of the crib, said first and second pairs of anchor arms being telescopically adjustable along a longitudinal length thereof such that said basket can be attached to alternate portions of the crib while said basket remains medially and centrally oriented within the crib, wherein each of said first and second pairs of anchor arms are independently articulated such that said basket is longitudinally adjusted within said crib, wherein said first and second pairs of anchor arms are pivotal along a path coplanar with an oscillating path of said basket;

a plurality of support levers removably conjoined directly to a top edge of the crib wherein said support levers are linearly displaced along said top edge such that said first and second pairs of anchor arms become articulated about said proximal ends thereof respectively, said distal ends of said first and second pairs of anchor arms being pivotally connected to support levers such that said proximal and distal ends of said anchor arms are simultaneously pivotal about vertically registered fulcrum axes, wherein said support levers maintain said basket in a substantially horizontal position and spaced from a bottom surface of the crib such that said basket freely oscillates during operating conditions;

means for symmetrically oscillating said basket along a horizontal plane while said first and second pairs of anchor arms remain statically engaged with said top edge of the crib; and means for automatically playing back an audio file while said basket is oscillating.

14. The rocker of claim 13, wherein said basket oscillating means comprises:

an axle and a chamfered drum journaled thereabout, said chamfered drum having an oscillating groove defined along an outer circumference thereof and continuously extending along an outer surface of said drum;

a motor electrically coupled to said drum and housed on an exterior of said basket;

a linear drive shaft provided with a rotary ball bearing attached to a first end thereof, said ball bearing being freely interfitted within said groove such that said ball bearing travels an entire length of said groove while said drum rotates;

a threaded coupling directly mated to a second end of said driveshaft;

a rectilinear driven shaft having first and second ends directly mated to said coupling and one of said ends of said basket respectively;

a threaded rod directly passed through said coupling, wherein said basket is uniformly displaced along a longitudinal length of said rod while said ball bearing travels along said groove such that said basket oscillates in sync with a travel path of said ball bearing; and a user interface electrically mated to said motor such that a caregiver can manually adjust an operating mode of said basket oscillating means.

15. The rocker of claim 13, wherein said audio file playback means comprises:

a rechargeable power supply source;

a sensor electrically coupled to said power supply source and said basket oscillating means;

a digital audio file playback device; and a transducer operably connected directly to said mattress and electrically mated to said sensor and said audio file playback device respectively.

16. The sensor of claim 15, wherein said sensor generates and transmits a first control signal to said audio file playback device when said oscillating movement is detected in said basket such that said audio file playback device automatically toggles between on and off positions when said basket oscillates and remains at equilibrium respectively, said sensor further generating and transmitting a second control signal to said transducer when either one of said basket oscillating means and said audio file playback device are adapted to an operating mode.

17. The basket oscillating means of claim 14, wherein said user interface includes a plurality of switches integrally formed within a top surface thereof such that a user can selectively control an vibration intensity and duration of oscillation of said basket, said user interface further includes a variable pitch generating circuit for allowing a user to select various sounds to emit from said mattress, said control panel being electrically mated to a power supply and housed in an exterior surface thereof.

18. The rocker of claim 13, wherein said removable mattress is formed from a soft water-resistant material such that an infant can comfortably rest thereon, said mattress being machine washable such that said mattress can be cleaned and used repeatedly.

* * * * *